United States Patent [19]

Snelgrove et al.

[11] Patent Number: 4,465,039

[45] Date of Patent: Aug. 14, 1984

[54] ENGINE BLOCK HEATER WITH EXPANSION YOKE

[75] Inventors: Ronald C. Snelgrove, Scarborough; Joseph B. Brinkhof, Oshawa, both of Canada

[73] Assignee: Budd Canada Inc., Kitchener, Canada

[21] Appl. No.: 449,573

[22] Filed: Dec. 14, 1982

Related U.S. Application Data

[63] Continuation of Ser. No. 175,945, Aug. 7, 1980, abandoned.

[30] Foreign Application Priority Data

Sep. 28, 1979 [CA] Canada ..... 336783

[51] Int. Cl.[3] ..... F02N 17/02

[52] U.S. Cl. ..... 123/142.5 E; 219/208; 219/318; 219/336; 220/243; 220/235

[58] Field of Search ..... 123/142.5 E; 219/205, 219/208, 318, 335, 336, 536; 220/243, 251, 235, 323

[56] References Cited

U.S. PATENT DOCUMENTS

| | | | |
|---|---|---|---|
| 737,667 | 9/1903 | Schonck | 251/25 |
| 2,256,217 | 9/1941 | Pearson | 220/243 |
| 2,987,283 | 6/1961 | Bleckmann | 248/56 |
| 3,148,268 | 9/1964 | Heinbuch | 123/142.5 E |
| 3,165,621 | 1/1965 | Windsor | 219/536 |
| 3,587,548 | 6/1971 | Wernicke | 123/142.5 E |
| 3,646,314 | 2/1972 | Windsor | 123/142.5 E |
| 3,766,356 | 10/1973 | Feldmann | 123/142.5 E |
| 4,175,229 | 11/1979 | Brinkhof et al. | 123/142.5 E |
| 4,242,564 | 12/1980 | Kendall | 123/142.5 E |

FOREIGN PATENT DOCUMENTS

| | | | |
|---|---|---|---|
| 850767 | 9/1970 | Canada . | |
| 321744 | 10/1934 | Italy | 220/243 |

*Primary Examiner*—Ira S. Lazarus

*Attorney, Agent, or Firm*—Hill, Van Santen, Steadman & Simpson

[57] ABSTRACT

An engine block heater adapted for insertion in an opening in the block wall of an automobile engine has a plug member and a novel yoke assembly for securing the heater within the opening. The yoke assembly includes a pair of wing members each having one end thereof abutting the inner face of the heater plug. Each of the wing members is hingedly mounted on and carried by a respective one of the opposite ends of a pressure bar so that each wing member is pivotable about the associated end of the pressure bar and adapted to fulcrum thereon. A screw passes through an axially extending opening in the plug member and is threaded into a tapped opening in the pressure bar. Upon insertion of the heater in the opening in the block wall, the screw is tightened to draw the pressure bar towards the inner face of the heater, thus causing the wing members to pivot about the ends of the pressure bar. This results in those ends of the wing members that contact the inner face of the heater plug being moved slidably towards each other across the inner face while the outer ends of the wing members are moved apart from each other until they overlie and engage with the inner surface of the engine block wall about the inner end of the opening.

9 Claims, 9 Drawing Figures

FIG.2.
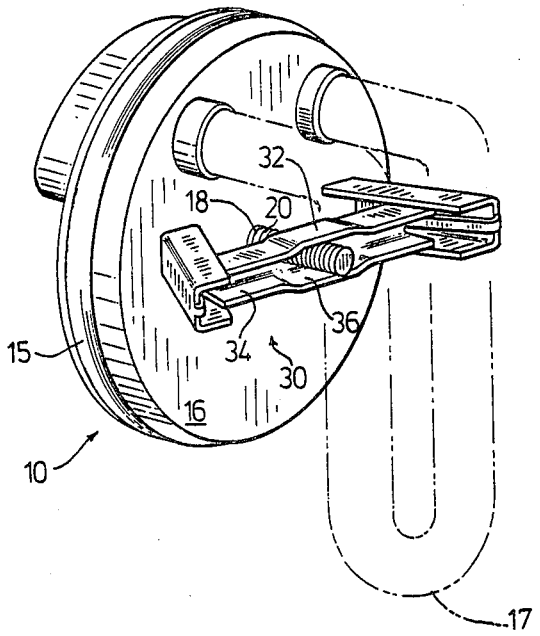
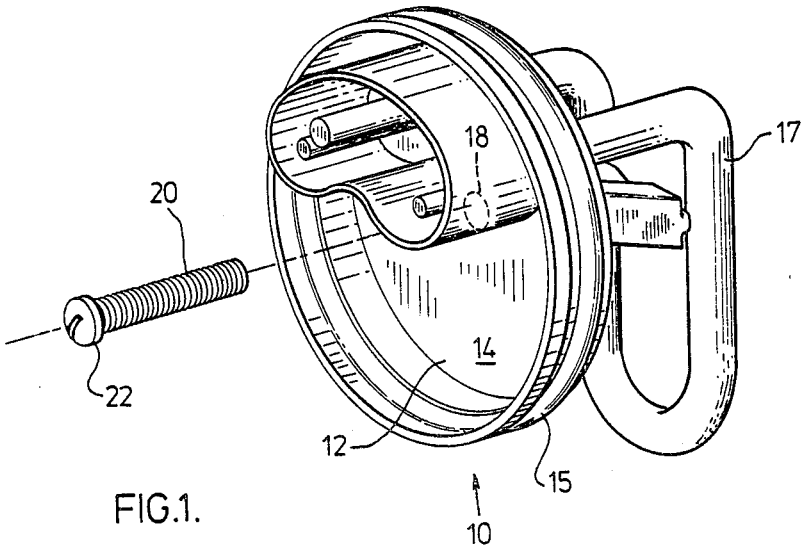
FIG.1.

ENGINE BLOCK HEATER WITH EXPANSION YOKE

This is a continuation of Ser. No. 175,945, filed Aug. 7, 1980, now abandoned.

This invention relates to improvements in engine block heaters for automobiles. In particular it relates to improvements in the method of retaining the heaters in the core hole of the engine block.

In the construction of internal combustion engines adapted to be water cooled it is common practise to cast the cylinder block and water jacket in one piece using sand moulding. Apertures are provided for the removal of the sand following the casting operation; when the engines are finally assembled the apertures may be sealed with suitable dished plates.

Advantage is commonly taken of these apertures for the fitting of an electric heating means in the engine. A suitable device of the prior art is described in Canadian Pat. No. 850,767, dated Sept. 1, 1970 to Ehgoetz, of common assignment herewith. The Ehgoetz device comprises a dished body from which a metal sheathed heating element projects. Around the periphery of the body an O-ring seal is carried which seals within the bore of the aperture in the engine block. The retaining means employed by the patentee comprises a yoke bar which is attached to the heater body by a screw means loosely journaled in the body. The yoke is of greater length than the diameter of the block aperture and requires to be manipulated therethrough by suitably tilting the assembly during insertion, following which the yoke is centered across the aperture and drawn tight by tightening the screw means.

In certain automotive engines spatial limitations of the block have not permitted the ready introduction of a yoke of the type described by Ehgoetz. It is known in the prior art, for example as described in Canadian Pat. No. 963,518 issued Feb. 25, 1975 to Feldmann, to employ in an engine block heater a yoke assembly having an initial diametrical dimension less than that of the aperture to be fitted. The Feldmann block heater comprises a plate having a central opening therein, a screw passing through the opening, and a yoke secured to the screw and actuated thereby. The yoke assembly comprises an elongated clamping member of bendable material having its center portion journalled on the screw; the clamping member having a pair of diverging wings extending from the center portion. The yoke assembly further comprises a pressure bar connected to the screw such that when the screw is tightened the pressure bar bears against the wings causing them to bend and increase the effective diameter of the clamping member whereby the tips of the wings overlie and engage wall portions of the engine block surrounding the aperture.

In the above prior art arrangement the screw passes through the center portion of a clamping member. Under certain circumstances, the clamping member rotates about the polar axis of the screw and may be brought into jamming relation with other parts of the heater, which necessitates the application of a relatively high torque to draw the pressure bar down on its wings. Under adverse conditions the interference may be such as to cause the blockheater, as a whole, to rotate. Also, the prior art arrangement does not preclude the occurrence of undesired relative polar rotational movement between the pressure bar and wings in certain instances.

Lastly, the prior art arrangement is not removable after it has been inserted in the engine block.

It is therefore an object of the present invention to provide an improved engine block heater that precludes relative polar rotational movement between its wing members and its pressure bar.

It is another object of the present invention to provide an improved engine block heater that is reusable and removable after installation.

Briefly stated, the present invention provides a yoke assembly for use in an engine block heater wherein two wing members are hingedly mounted on and carried by respective opposite ends of a pressure bar so that each wing member is pivotable intermediate its ends about the end of the pressure bar on which mounted, and so that relative polar rotational movement between each wing member and the pressure bar is precluded. A screw extending through an axially extending opening in a plug or body member of the block heater is threaded into a threaded opening in the pressure bar. Thus a separate central portion for the wing members is eliminated because the wing members are hingedly mounted on and carried by the pressure bar.

In the preferred construction, a bendable neck portion is provided at each end of the pressure bar. Each neck portion connects the associated wing member end furthest from the plug member with the corresponding pressure bar end. In an alternate construction, the pressure bar and the wing members are channel shaped in cross-section, and a pivot pin is located at each end of the pressure bar. Each pivot pin extends through the channel walls of the pressure bar and engages the associated channel walls of the wing member intermediate its ends, in pivotal supporting relationship therewith.

A feature of both the preferred and alternate constructions is that the heaters can be removed from the block after installation has been made. In the preferred construction, the screw may be loosened backing off the yoke assembly from the plunger member. Because the wing members and the pressure bar lock in fixed relation after the screw has been fully tightened in the preferred embodiment, the yoke assembly may be readily manipulated through the aperture by tilting the assembly once the screw is loosened. It the alternate construction, once the screw is loosened the plug member may be pulled straight out of the aperture as, in this construction, the wing members and the pressure bar do not lock in mutually fixed relation.

Pursuant to the present invention, there is provided an engine block heater adapted to be inserted into, and to be secured in, an opening in an engine block wall having inner and outer surfaces about the opening, the block heater including a plug member having an outer face and an inner face and shoulder means on the plug member adjacent to the outer face retainingly engageable with the outer surface, a heating element projecting from the inner face and a yoke assembly positioned adjacent to the inner face for securing the plug member within the opening in cooperation with the shoulder means, the yoke assembly comprising a pressure bar substantially shorter than the diameter of said opening and having opposite ends, a pair of wing members mounted on and carried by the pressure bar and each wing member having a first end positioned between said bar and the inner face, one of the wing members extending obliquely across one end of the bar and the other of the wing members extending obliquely across the opposite end of the bar whereby the wing members extend in a diverging relationship away from the inner face and are fulcrumed on the bar ends, hinging means connecting each of the wing members to the associated bar end so that each wing member is pivotable intermediate said first and second ends thereof about the fulcrum on the associated end of the pressure bar, and a screw element extending through an opening which extends in the plug member through both of the faces, and the screw element being in threaded engagement in a tapped hole located intermediately in the pressure bar, whereby as the screw element is tightened at the outer face the pressure bar is drawn towards the inner face and each wing member pivots about its fulcrum as the first ends of the wing members are caused to be displaced toward each other slidably along the inner face while the second ends of the wing members move away from each other until the second ends lie in overlapped plug member retaining engaging relationship with portions of the engine block wall inner surface.

For a better understanding of the nature and objects of the invention reference may be had, by way of example, to the accompanying diagrammatic drawings in which:

FIG. 1 is a perspective partly exploded view looking towards the outer face of an engine block heater wherein the yoke assembly of the present invention is employed;

FIG. 2 is a perspective view looking towards the inner face of the engine block heater, the heating element being shown in dotted outline so as to reveal structural detail of the yoke assembly;

Figure 5:
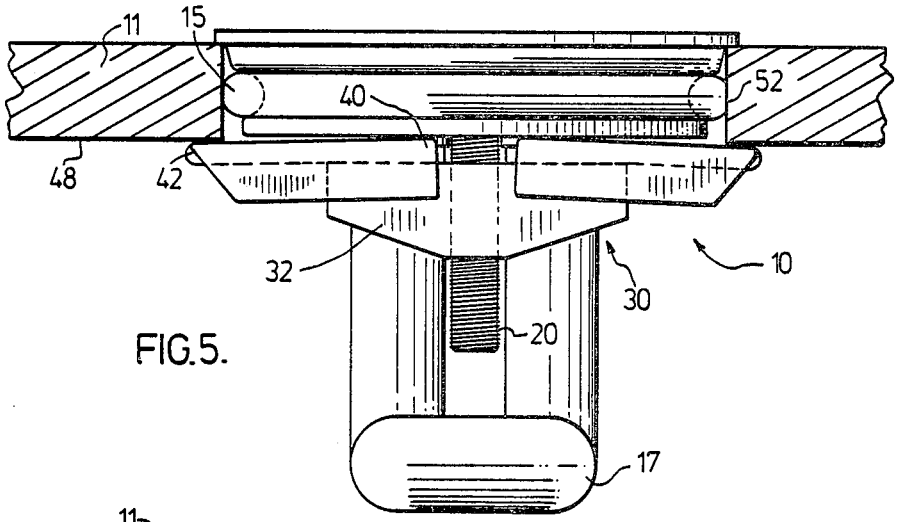
FIG. 5 is similar to FIG. 4, but shows the yoke assembly fully opened to retain the engine block heater in position.
Figure 4:
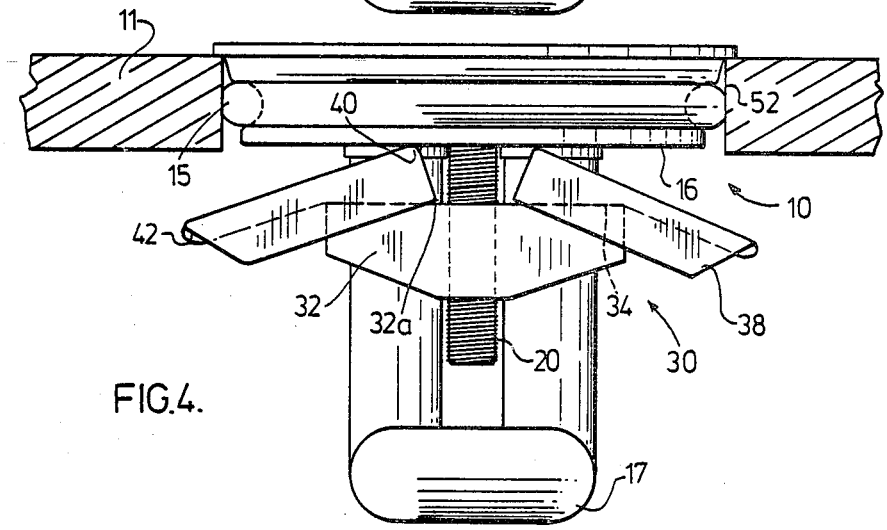
FIG. 4 is an elevational view of the engine block heater fitted into the aperture with the yoke assembly in a partially opened condition.
Figure 3:
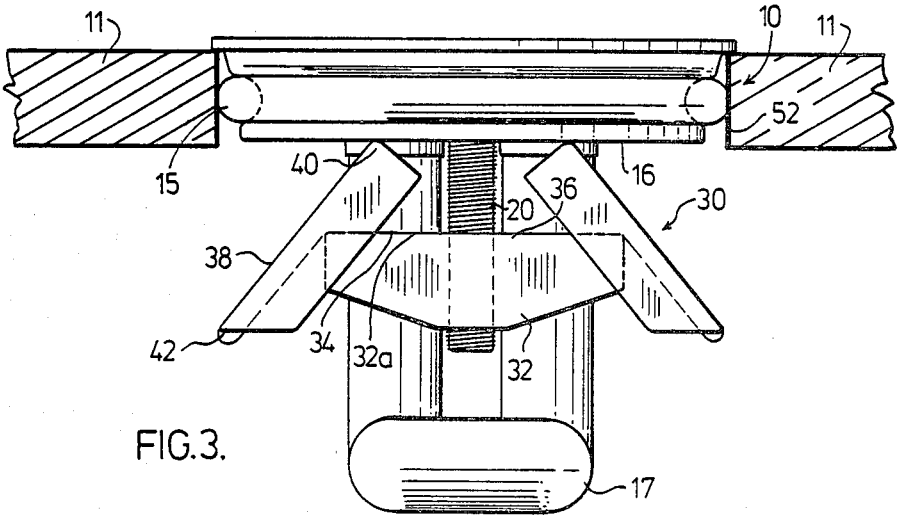
FIG. 3 is an elevational view of the engine block heater inserted within an aperture of an engine block wall.

Referring now to FIGS. 1 and 2 the engine block heater of the preferred embodiment is represented generally at 10. Heater 10 comprises a plug member 12 having outer and inner faces, 14 and 16 respectively. An O-ring 15 is located in a groove on the peripheral surface of plug member 12 to provide a fluid tight seal between the plug member 12 and the engine block wall 11 (as shown in FIGS. 3, 4, and 5). A bent metal sheathed heating element 17 projects from the inner face 16. Plug member 12 has a central opening 18, through which projects a screw element or machine screw 20 having its head 22 accessible at the outer face 14 of the plug member 12.

Figure 8:
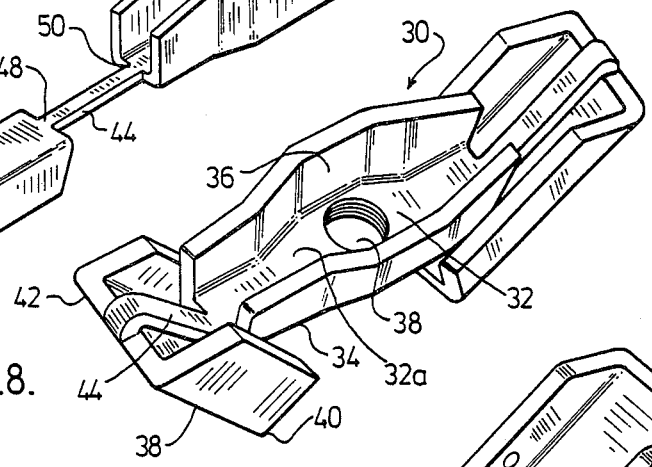

With reference now also to FIGS. 3 and 8, a yoke assembly is shown generally therein as 30, and comprises a pressure bar 32 having a pair of legs 34 extending outwardly from hub portion 36. Hub portion 36 has a central threaded opening 38 into which screw 20 is threaded. At the outer end of each leg 34 of pressure bar 32 is located a wing member 38 in alignment with a corresponding leg 34 or end of pressure bar 32. Each wing member has a first end 40 positioned adjacent the inner face 16 and a second end 42 located so that the two wing members extend in a diverging relationship away from the inner face 16 (FIG. 3). Each wing member 38 is hingedly mounted on and carried by the pressure bar 32, a connection being provided by a hinging means on a respective associated end portion or leg 34 of pressure bar 32 whereby the end portion or leg 34 provide a fulcrum at an intermediate portion of the associated wing member 38 between the first and second ends 40, 42 of wing member 38. In this preferred embodiment the hinging mens comprises a respective bendable metal neck portion 44 that connects the second end 42 of each wing member 38 integrally with the associated pressure bar end portion or leg 34. As shown, neck portion 44 lies flush against the wing member 38 and is bendable at its connection to the pressure bar end portion or leg 34. The hinge means permits pivotal movement of wing members 38 about their fulcrums in the plane of bar 32. The hinge means also precludes relative polar rotation between bar 32 and wing member 38 about screw 20.

Figure 6:
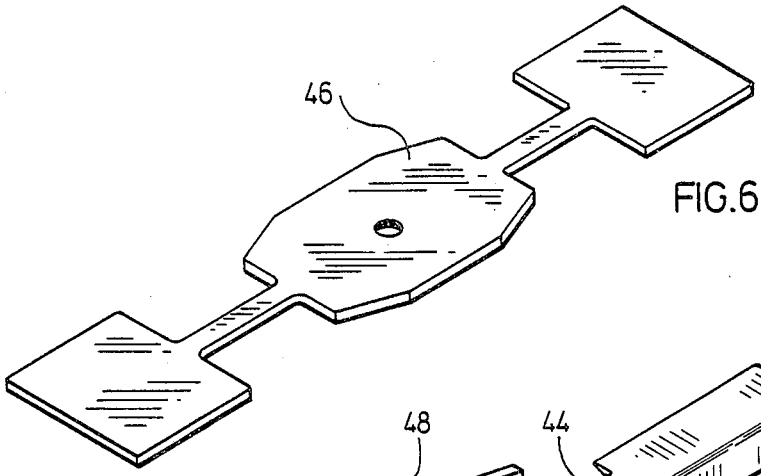
FIGS. 6, 7 and 8 show steps in the manufacture of the preferred embodiment of the yoke assembly of the engine block heater; and, FIG. 9 shows a second embodiment of the yoke assembly as an alternative to that shown in FIG. 8.
Figure 7:
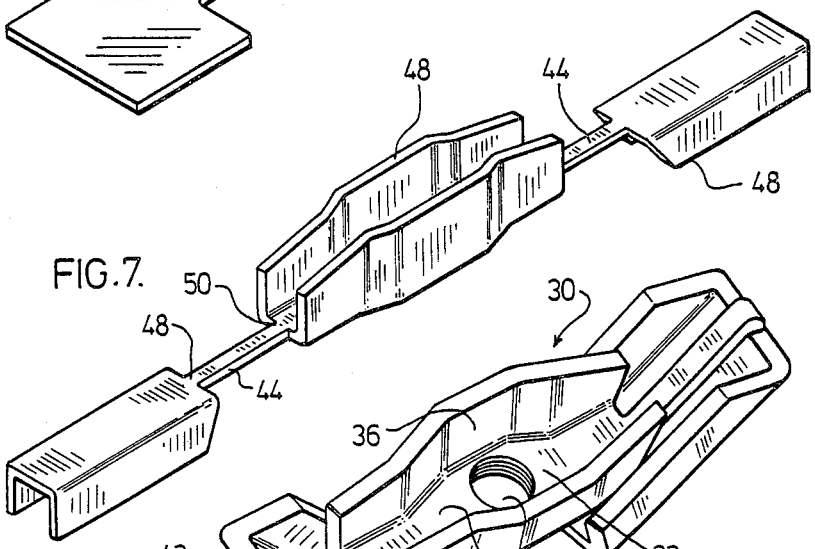

Referring to FIGS. 6 to 8 the yoke assembly 30 is formed by punching out the strip 46 and subsequently bending strip 46 to form channel walls 48 of the pressure bar. The neck portions 44 (FIG. 7) are bent at junctions 48 and 50 to form the assembly 30 shown in FIG. 8. As seen in FIG. 8, the end portions 34 of bar 32, are internestingly seated in the wing members 38.

Referring now to FIGS. 1 to 5 and more particularly to FIGS. 3 to 5 the insertion and securing of the heater 10 in engine block wall 11 is now described. The heater 10 shown in FIG. 3 is suitable for insertion inwardly into an opening 52 in engine block wall 11 which has inner and outer surfaces about the opening 52. Once the heater 10 is fully inserted into the opening 52, conventional shoulder means on the plug 12 adjacent to the outer face 16 engages the outer surface of the block wall 11 (FIG. 3), and screw 20 may be tightened, drawing bar 32 towards inner face 16 of plug member 12. As bar 32 is drawn towards inner face 16 (FIG. 4), wing members 38 pivot about their fulcrums on end portions 34 of bar 32 whereby the first ends 40 of the wing members 38 move slightly towards each other on inner face 16 and the second ends 42 move away from one another until second ends 42 of the wing members 38 lie in overlapped engaging relationship with portions of the inner surface of the engine block wall surrounding opening 52. At this point, wings 38 are locked in fixed relationship with pressure bar 32 and cooperate with the shoulder means at the outer end of the plug 12 to retain the heater 10 positively in place.

To effect removal of the heater from the engine block, screw 20 may be loosened to back off bar 32 and wings 38 from the inner face 16 of plug member 12. This permits the plug member 12 to be pulled from the aperture of the engine block wall by suitably tilting plug member 12 to allow the yoke assembly to pass through the aperture.

Figure 9:
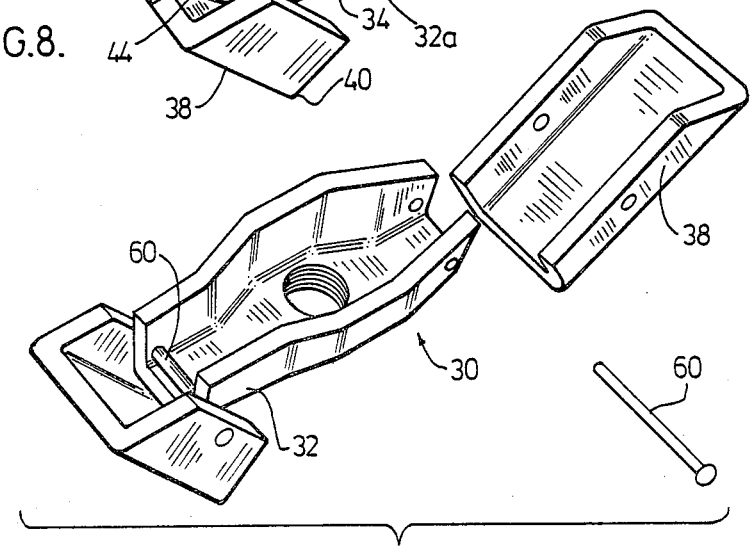

Referring now to FIG. 9 there is shown an alternative embodiment for the yoke assembly 30 wherein wing members 38 are hinged to pressure bar 32 by means of pivot pins 60 passing through suitable pin holes intermediate the lengths of the channel walls of the wing members 38 and the bar 32, the structural relationships and functions of the device being otherwise the same as already described.

It should be understood that other embodiments may be apparent to a person skilled in the art in view of the foregoing description of the present invention. Accordingly, the present invention should only be limited to only that which is claimed in the accompanying claims.

The embodiments of the invention in which an exclusive property or privilege is claimed are defined as follows:

1. In an engine block heater adapted to be inserted into, and to be secured in, an opening in an engine block wall having inner and outer surfaces about said opening, said block heater including a plug member having an outer face and an inner face and shoulder means on the plug member adjacent to said outer face retainingly engageable with said outer surface, a heating element projecting from said inner face and a yoke assembly positioned adjacent to said inner face for securing said plug member within said opening in cooperation with said shoulder means, said yoke assembly comprising:

a pressure bar substantially shorter than the diameter of said opening and having opposite ends;

a pair of wing members mounted on and carried by said pressure bar and each having a first end positioned between said bar and said inner face, one of said wing members extending obliquely across one end of said bar and the other of said wing members extending obliquely across the opposite end of said bar whereby said wing members extend in a diverging relationship away from said inner face and are fulcrumed on said bar ends;

hinging means connecting each of said wing members individually directly to the associated bar end so that each wing member is pivotable intermediate said first and the second ends thereof about the fulcrum on the associated end of said pressure bar; and a screw element extending through an opening which extends in said plug member through both of said faces, and said screw element being in engagement with said pressure bar, so that as said screw element is tightened at said outer face, said presssure bar is drawn towards said inner face and each wing member pivots about its fulcrum as said first ends of said wing members are caused to be moved toward each other slidably on said inner face while said second ends of said wing members move away from each other until said second ends lie in overlapped plug member retaining engaging relationship with wall portions of said engine block wall inner surface.

2. An engine block heater according to claim 1, wherein said hinging means comprises a bendable neck portion at each end of said pressure bar, each neck portion connecting said second end of the associated wing member to the associated end of said pressure bar.

3. An engine block heater according to claim 2, wherein each of said neck portions lies flush against the associated wing member and the neck portion is bendable at its connection with the associated end of said pressure bar.

4. An engine block heater according to claim 3, wherein said wing members and said neck portions are integrally in one piece with said pressure bar.

5. An engine block heater according to claim 1 or 4, wherein said pressure bar and said wing members are channel-shaped in cross-section.

6. An engine block heater according to claim 1 or 4, wherein said pressure bar and said wing members are channel-shaped in cross-section, and each end of said pressure bar is seated within the channel of the associated wing member.

7. An engine block heater according to claim 1 or 2, wherein said wing members are located in fixed relationship with said pressure bar when said screw element is fully tightened.

8. An engine block heater according to claim 1, wherein said wing members are channel-shaped in cross-section and said pressure bar ends are substantially nested in said wing members, and said hinging means comprises a pivot pin at each end of said pressure bar, each pivot pin extending through an end portion of said pressure bar and engaging channel walls of the associated wing member intermediate said first and second ends thereof in pivotal connecting relationship therewith.

9. An engine block heater according to claim 1, wherein said screw member is threaded into a tapped hole located intermediately in said pressure bar.

* * * * *